United States Patent [19]

Baczuk

[11] 4,045,261

[45] Aug. 30, 1977

[54] MOLECULAR SIEVE CONTAINING STABILIZATION SYSTEM FOR URETHANE - CROSSLINKED DOUBLE BASE PROPELLANT

[75] Inventor: Robert J. Baczuk, Salt Lake City, Utah

[73] Assignee: The United States of America as represented by the Secretary of the Navy, Washington, D.C.

[21] Appl. No.: 710,955

[22] Filed: Aug. 2, 1976

[51] Int. Cl.[2] ..... C06B 45/10

[52] U.S. Cl. ..... 149/19.8; 149/19.4; 149/20; 149/100; 149/110

[58] Field of Search ..... 149/19.1, 19.3, 19.4, 149/19.8, 19.9, 20, 100, 110, 108.8

[56] References Cited

U.S. PATENT DOCUMENTS

| | | | |
|---|---|---|---|
| 2,967,098 | 1/1961 | Weil | 149/19.8 |
| 3,894,894 | 7/1975 | Elrick | 149/19.8 X |
| 3,905,846 | 9/1975 | Berta | 149/19.4 |
| 3,969,166 | 7/1976 | Sayles | 149/19.4 |

*Primary Examiner*—Edward A. Miller

*Attorney, Agent, or Firm*—R. S. Sciascia; Charles D. B. Curry

[57] ABSTRACT

A dual stabilization system for urethane - crosslinked double base propellant. The stabilization system includes N-Methyl-p-Nitroaniline and Aluminum Silicate molecular sieve. The two stabilizers function in a complementary fashion wherein the N-Methyl-p-Nitroaniline reacts with and makes harmless the nitrogen (III) oxide during the propellant aging process. The Aluminum Silicate molecular sieve is selected to have a pore size of more than about 10 angstroms and reacts with and makes harmless the nitrogen (V) oxides, primarily nitric acid, during the propellant aging process.

3 Claims, No Drawings

MOLECULAR SIEVE CONTAINING STABILIZATION SYSTEM FOR URETHANE - CROSSLINKED DOUBLE BASE PROPELLANT

BACKGROUND OF THE INVENTION

1. Field of the Invention

The present invention relates to a urethane-crosslinked double base propellant and more particularly to a stabilization system for urethane - crosslinked double base propellants.

2. Description of the Prior Art

One of the problems encountered in nitrate ester systems such as propellant casting powder and explosives and urethane -crosslinked nitrate ester propellants is that their aging process during storage and the like may result in the generation of certain undesirable products that partially interfere with or destroy the desirable characteristics of the propellant. The principal products generated in the aging process of nitrate esters include $N_2O_4$, $NO^+$, $NO_3^-$, $NO_2^+$, $NO_2^-$, $N_2$, $CO_2$, and NO. Other products are also produced.

The product invention is a complementary dual stabilizer system that converts the most harmful of the above described products into relatively harmless products.

SUMMARY OF THE INVENTION

Briefly, the present invention comprises a dual stabilization system for urethane - crosslinked double base propellant. The stabilization system includes N-Methyl-p-Nitroaniline and Aluminum Silicate molecular sieve. The stabilizers function in a complementary fashion wherein the N-Methyl-p-Nitroaniline reacts with and makes harmless the nitrogen (III) oxide during the Propellant aging process. The Aluminum Silicate molecular sieve is selected to have a pore size of more than about 10 angstroms and reacts with and makes harmless the nitrogen (V) oxides, primarily nitric acid, during the propellant aging process.

STATEMENT OF THE OBJECTS OF THE INVENTION

An object of the present invention is to provide a propellant that retains its desired characteristics during aging.

Another object of the present invention is to provide a propellant that includes an effective dual stabilizer system that minimizes the retention of harmful chemicals during the aging process.

Still another object of the present invention is to provide a stabilization system that is particularly effective for urethane - crosslinked double based propellants.

Other objects, advantages and novel features of the invention will become apparent from the following detailed description of the invention.

DESCRIPTION OF THE PREFERRED EMBODIMENT

A urethane - crosslinked double base propellant with which the stabilization system of the present invention has been found to be effective includes a binder, a binder-oxydizer, one or more principal oxydizers, fuel and a burning rate modifier. These constituents may be chemically characterized as follows:

Binder

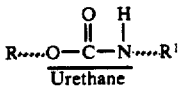

where

R is a polymer chain radical $R^1$ is a polymer chain radical that may or may not be the same as R.

Binder-oxydizer [Nitrocellulose (NC)]

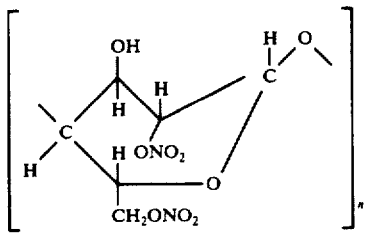

where $n$ = the number of repeating units which is the function of the type of nitrocellulose.

Principal Oxydizer [Nitroglycerin (NG)]

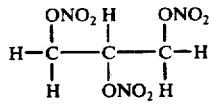

Principal Oxydizer (HMX)

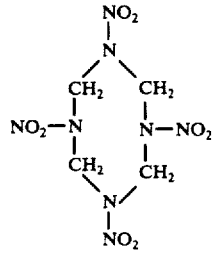

Burning Rate Modifier (Ammonium Perchlorate)

$NH_4CLO_4$

Fuel — Aluminum

Al

The stabilizers comprising the dual complementary stabilizer system of the present invention include:

N-Methyl-p-Nitroaniline (hereafter referred to as MNA) and

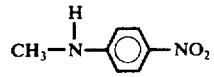

Aluminum Silicate (Al,Si,O) (molecular sieve powder)

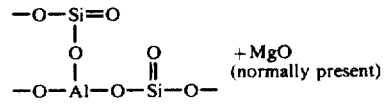

It is important that the pore size of the Aluminum Silicate molecular sieve is selected to be greater than about 10 angstroms.

Mechanism

Nitrogen dioxide ($NO_2$), the principal product generated in the aging process of nitrate esters, disproportionates in the following manner:

$$2NO_2 \rightleftharpoons N_2O_4 \begin{cases} NO^+ + NO_3^- & (1) \\ NO_2^+ + NO_2^- & (2) \end{cases}$$

where $NO_2$ is nitrogen dioxide $N_2O_4$ is nitrogen tetroxide $NO^+$ is nitrogen (III) oxide (nitrosonium ion)

$NO_2^+$ is a nitrogen (V) oxide (nitronium ion)

$NO_3^-$ is a nitrogen (V) oxide which eventually leads to nitric acid ($HNO_3$)

Reaction (1) causes an auto catalytic decomposition of the nitrocellulose (NC) and the nitroglycerin (NG) in the propellant to breakdown to yield more NO if not stabilized. This produces undesirable heat and can cause propellant burning.

The products of both equations (1) and (2) are present when the stabilizer MNA is not present is the propellant and only the nitrogen V oxides are present when the stabilizer MNA is present. MNA is desirable as the stabilizer for nitrocellulose (NC) and nitroglycerin (NG).

The disproportionation to nitrosonium nitrate, equation (1), is the perdominant equilibrium in propellants, containing a RNH functionality, forming nitroso derivatives which readily decompose to gases:

$$\underset{\text{urea or urethane}}{RNH} + NO^+ + NO_3^- \rightarrow \underset{\text{Unstable Nitroso Derivative}}{RN{-}NO} + \underset{\text{Nitric Acid}}{HNO_3} \quad (3)$$

The nitric acid also generated is undesirable as it can acid saponify ester and urethane functional groups to degrade the binder and also can degrade nitrate esters as well.

The stabilizer system of the present invention eliminates this nitrosation of the binder and completely removes all nitrogen oxides produced in the aging of nitrate ester explosives. First, MNA nitrosates much faster than the urea of urethane functionalities, forming a stable N-nitroso derivative which can rearrange to a stable C-nitroso derivative (N-methyl-o-nitroso-p-nitroaniline):

(4)

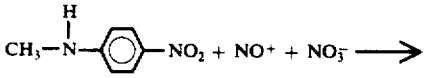

-continued

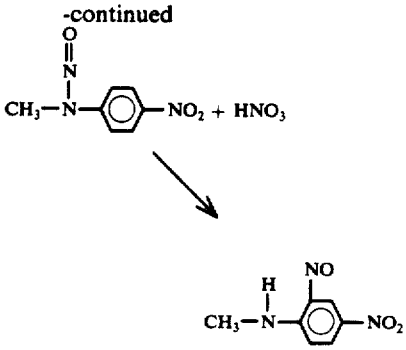

Referring to equation (4) the first product,

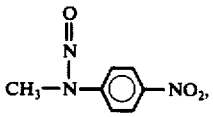

is non-reactive and harmless in the propellant; the third product,

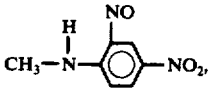

does not occur as a product during the normal stored life of a propellant for rocket motors. However, the second product $HNO_3$ (nitric acid) is harmful and undesirable.

The function of the second stabilizer (aluminum silicate - molecular sieve) is to eliminate or minimize the effect of $HNO_3$ as follows:

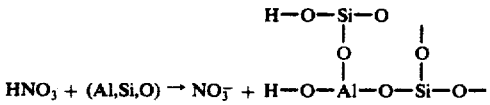

Nitric acid scavenging by the porous aluminosilicates is primarily an acid-base interaction. The primary benefit achieved in this process comes from this buffering action as the nitrate ion is inocuous as a neutral ion but an oxidizing ion in an acid environment. The products of the neutralization are then the protonated aluminosilicate and nitrate ion which is absorbed into the matrix of the aluminosilicate also.

Experiments have shown that the use of the second stabilizer (Aluminum Silicate molecular sieve having a pore size that is selected to be greater than about 10 angstroms) has reduced the acidity from a pH of 1.4 (without second stabilizer to a pH of 7.2 (with second stabilizer).

EXAMPLE

A typical propellant formulation was prepared with the above stabilizers and its composition was as follows:

| | % by weight |
|---|---|
| Urethane - crosslinked double base propellant | 97.8 |
| MNA | 2.0 |
| Aluminum Silicate molecular sieve | 0.2 |

-continued

| | % by weight |
|---|---|
| (greater than about 10 angstroms pore size) | |

It should be noted that aluminum silicate molecular sieves will generally include some magnesium oxide (MgO). Since MgO will react with water to form undesirable base material in the presence of NC and NG it is desirable to store the propellant in a low humidity atmosphere. Alternatively, the MgO could be removed from the aluminum silicate molecular seive during manufacture.

What is claimed is:

1. A solid urethane - crosslinked double base propellant comprising nitrocellulose, nitroglycerin, HMX, amonium perchlorate, aluminum, N-Methyl-p-Nitroaniline and aluminum silicate molecular sieve.

2. The propellant composition of claim 1, wherein said aluminum silicate molecular sieve has a pore size selected to be greater than about 10 angstroms.

3. The propellant composition of claim 2 wherein said N-Methyl-p-Nitroaniline comprises about 2.0 percent by weight of said propellant and said aluminum silicate molecular sieve comprises about 0.2 percent by weight of said propellant.

* * * * *